US009878211B1

(12) United States Patent
Knowles

(10) Patent No.: US 9,878,211 B1
(45) Date of Patent: Jan. 30, 2018

(54) PROPULSION SYSTEM

(71) Applicant: RIG LLC, Kahului, HI (US)

(72) Inventor: Justin Knowles, Kihei, HI (US)

(73) Assignee: RIG LLC, Kahului, HI (US)

( * ) Notice: Subject to any disclaimer, the term of this patent is extended or adjusted under 35 U.S.C. 154(b) by 0 days.

(21) Appl. No.: 15/363,358

(22) Filed: Nov. 29, 2016

(51) Int. Cl.
*A63B 35/00* (2006.01)

(52) U.S. Cl.
CPC ..... *A63B 35/00* (2013.01)

(58) Field of Classification Search
CPC ..... A63B 35/00
USPC ..... 114/315
See application file for complete search history.

(56) References Cited

U.S. PATENT DOCUMENTS 4,010,619 A * 3/1977 Hightower ..... B63C 11/48 114/322
4,996,938 A * 3/1991 Cameron ..... A63B 35/12 114/315
5,323,727 A * 6/1994 Heaton ..... A63B 35/12 114/242
6,823,813 B2 * 11/2004 Mazin ..... A63B 35/12 114/315
8,567,336 B1 * 10/2013 Mazin ..... A63B 31/12 114/315
9,540,090 B2 * 1/2017 Fenu ..... B63H 25/02
2013/0291781 A1 * 11/2013 Myers ..... B63C 11/46 114/315
2014/0378013 A1 * 12/2014 Palairet ..... B63H 16/08 440/22

* cited by examiner

*Primary Examiner* — Lars A Olson
*Assistant Examiner* — Jovon Hayes
(74) *Attorney, Agent, or Firm* — Brown Rudnick LLP; Adam M. Schoen

(57) ABSTRACT

Disclosed is a propulsion system that comprises a power source coupled to a flotation device. The power source can be rechargeable. The system further comprises at least one thruster configured to be coupled to a person. A power cable operably couples the power source and the at least one thruster. The system is configured such that the at least one thruster propels the person through the water while the power source remains at a surface of the water and coupled to the flotation device. The system can include an air supply assembly.

20 Claims, 8 Drawing Sheets

PROPULSION SYSTEM

TECHNICAL FIELD

This disclosure relates to a propulsion system for an individual (e.g., a swimmer, snorkeler, surface air supplied diver, and/or diver).

BACKGROUND

Individuals (e.g., swimmers, snorkelers, surface air supplied diver, and/or divers) use propulsion devices to increase range in or under the water. These devices can be used for recreational, commercial or military purposes. There are products available to provide powered propulsion. These products usually consist of a casing containing a battery-powered electric motor, which drives a propeller. The power source in such designs is typically coupled to the system that is attached to the individual (e.g., on a harness/belt worn by the individual).

There are numerous problems with such a system design. For example, such designs often impart unnecessary weight onto the individual (e.g., a swimmer, snorkeler, surface air supplied diver, and/or diver). Additionally, providing a power source that is coupled to the individual can impede movement of the individual. Further, it is often costly to find an ergonomic design that balances both function and comfort. Moreover, providing a power source coupled to the individual can be unsafe. For example, the power source must be in a pressure resistant watertight casing; however, if the casing cracks or is ruptured, the individual can receive a significant shock from the power source.

SUMMARY

The invention provides propulsion systems in which the power source is at a location remote from the individual (e.g., physically separate or discrete). For example, a power source of the system is coupled to a flotation device. The one or more thrusters of the system are coupled to a person. A power cable operably couples the power source and the at least one thruster. In that manner, the system is configured such that the at least one thruster propels the person through the water while the power source remains at a surface of the water and coupled to the flotation device. Advantageously, the invention removes unnecessary weight from the individual thereby increasing the individual's agility and movement in the water. Importantly, the systems of the invention are safer than previous systems in which the power source was included within the propulsion system because the user is remote (and protected) from any of the dangers associated with the power source. For example, propulsion systems of the invention are safer because the risk of shock to the individual is significantly reduced.

Aspects of the invention provide a propulsion system that includes a power source coupled to a flotation device. The system further includes at least one thruster configured to be coupled to a person. A power cable operably couples the power source and the at least one thruster. In that manner, the system is configured such that the at least one thruster propels the person through the water while the power source remains at a surface of the water and coupled to the flotation device.

The skilled artisan will appreciate that numerous different types of power sources can be used with systems of the invention. For example, the power source can be a rechargeable power source, a single use battery, a fueled power source, or any combination thereof. The at least one thruster can be configured to be releasably coupled at least one part of the person. Exemplary coupling points include a waist, a torso, a back, legs, feet, arms, hands, or any combination thereof.

Similarly, the skilled artisan will appreciate that there are numerous types of flotation devices that be used with the systems of the invention. The particular type and design of the flotation device will depend, for example, on the design of the power supply (e.g., shape, weight, height), the conditions under which the system will be used (e.g., ocean, river, lake, pool, etc.) and possible other factors. Exemplary flotation devices include buoys or small craft such as inflatable rafts or boats.

In certain embodiments, the flotation device can be a buoy configured to float on a surface of the water. The buoy can have a shape selected from the group consisting of: round, oval, square, and rectangle. The buoy can further have a composition selected from the group consisting: hollow plastic, foam filled plastic, soft fabric, soft plastic, and a combination thereof.

The power source can be coupled to the flotation device in any manner, such as a top of the flotation device, a bottom of the flotation device, a side of the flotation device, a middle of the flotation device, or any combination thereof.

Numerous possible designs can be used for the power cable. In an exemplary design, the power cable can be an electrical transmission line providing electrical communication between the power source and the at least one thruster. In certain embodiments, the coupling among the power source, the power cable, and the at least one thruster can be in a strain relieved configuration. For example, the strain relieved configuration can include the power cable having a strain relief cord grip configured to relieve tension from the power cable. In another example, the strain relieved configuration can include a tether cable configured to couple the flotation device (e.g., buoy) to the person, in which the tether cable is coupled to the power cable to provide strain relief to the power cable. Additionally, the system may further include a reel coupled to the buoy. In an example, the reel can be configured to reel the person via the tether cable to the surface of the water.

In further embodiments, the propulsion system can further comprise a controller. In an example, the controller can be configured to afford variable speed control of the at least one thruster. Also, the at least one thruster can be a plurality of thrusters.

In other embodiments, the system can further comprise a harness. For example, the harness can be a waist belt. The skilled artisan will appreciate that numerous different types of harnesses can be used to couple systems of the invention to other coupling points of the individual (e.g., a waist, a torso, a back, legs, feet, arms, hands, or any combination thereof). An electrical router can be configured to provide an electrical connection to the power cable and to route power to the at least one thruster. The electrical router can be housed by the harness. Also, the system can comprise a controller that can be configured to provide user controls to at least the at least one thruster. The controller can also be housed by the harness and can be in electrical communication with the electrical router.

In other aspects, the invention provides a propulsion system that comprises an air supply assembly. An exemplary air supply assembly can comprise a snorkel and a mask. Another example is a surface supplied air system such as a compressed air tank. The propulsion system further comprises a power source coupled to a flotation device. The system further comprises at least one thruster configured to be coupled to a person. A power cable operably couples the power source and the at least one thruster. The system is configured such that the at least one thruster propels the person through the water while the power source remains at a surface of the water and coupled to the flotation device.

In other aspects, the invention provides a propulsion system that comprises a rechargeable power source coupled to a flotation device. Alternatively, the power source can be a single use battery, a fueled power source, or any combination thereof. The system further comprises at least one thruster configured to be coupled to a person. A power cable operably couples the power source and the at least one thruster. The system is configured such that the at least one thruster propels the person through the water while the power source remains at a surface of the water and coupled to the flotation device.

DESCRIPTION

Figure 1:
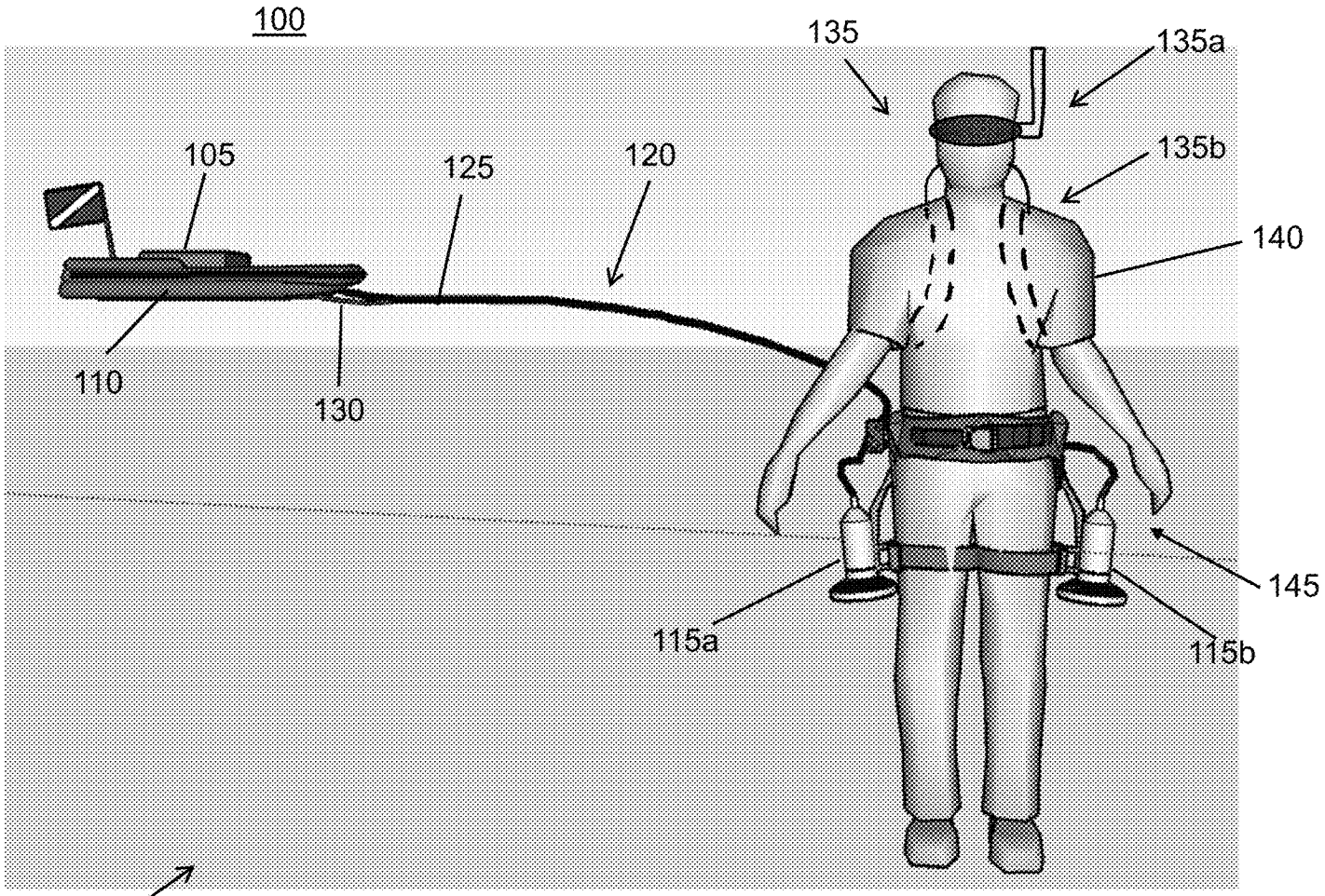
FIG. 1 illustrates a propulsion system for an individual (e.g., a swimmer, snorkeler, and/or diver) according to an exemplary embodiment of the present disclosure.

The invention provides a propulsion system for an individual (e.g., a swimmer, snorkeler, and/or diver) in which a power source is located at a location remote from the thrusters of the system that are coupled to the individual. FIG. 1 illustrates a propulsion system 100 for an individual 140 (e.g., a swimmer, snorkeler, and/or diver) according to one example embodiment of the present disclosure. The system 100 includes a power source 105 coupled to a flotation device 110. The system 100 further includes a power cable 125 that operably couples the power source 105 to thrusters 115*a-b*. For example, a first end of a cable bundle 120 is mechanically coupled to the flotation device 110. The cable bundle 120 houses the power cable 125 to provide a protective electrical coupling between the power cable 125 and the power source 105. A second end of the cable bundle 120 is coupled to the propulsion assembly 145 which is mechanically and electrically coupled to the thrusters 115*a-b*.

The cable bundle 120 further houses a tether cable 130. The tether cable 130 is coupled to the power cable 125 via the cable bundle 120 to provide strain relief to the power cable 125. This strain relieved configuration prevents the power cable 125 from becoming disengaged from either the flotation device 110 or the propulsion assembly 145 in response to receiving stresses associated with use of the propulsion system 100.

The system 100 is configured such that the thrusters 115*a-b* propel the individual through a body of water 160 while the power source 105 remains at a surface of the body of water 160 and coupled to the flotation device 110. Advantageously, this configuration removes unnecessary weight from the individual 140 thereby increasing agility and movement of the individual 140 in the body of water 160. Accordingly, the system 100 can utilize aspects of the propulsion systems taught by U.S. Pat. No. 6,823,813 B2, issued Nov. 30, 2004 to Mazin and U.S. Pat. No. 8,567,336 B1, issued on Oct. 29, 2013 to Mazin. The entire teachings of both patents are incorporated, in their entirety, herein by reference.

Optionally, an air supply assembly 135 is coupled to the individual 140. The air supply assembly 135 can be comprised of a snorkel and mask 135*a*. Alternatively or in combination, the air supply assembly 135 can comprise an air tank 130*b*. The air supply assembly 135 enables the individual 142 swim/dive while having access to a continuous supply of breathable air.

Figure 2:
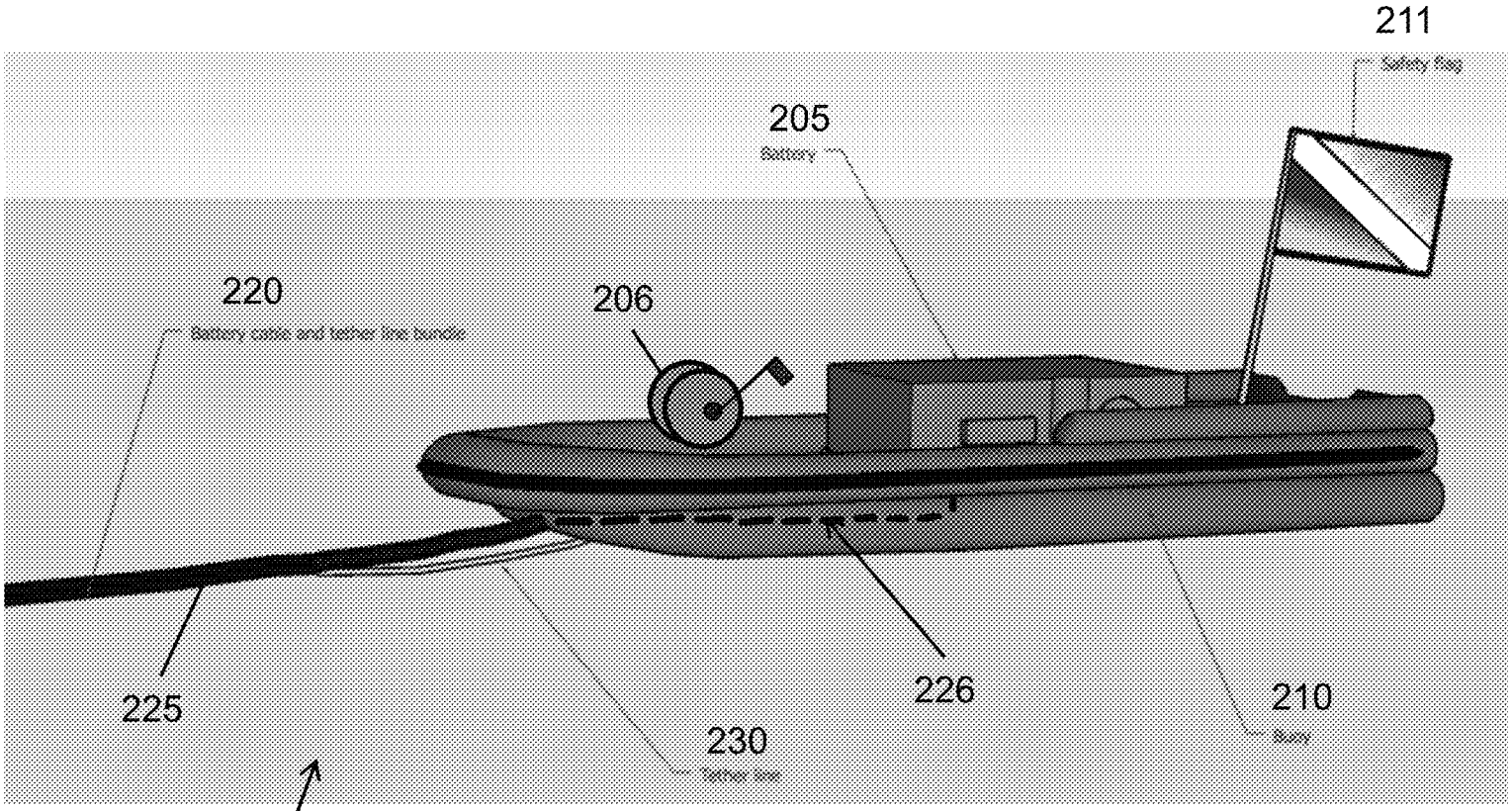
FIG. 2 is a schematic illustration of a power source coupled to a flotation device.

FIG. 2 is a schematic illustration of a battery 205 (e.g., the power source 105 of FIG. 1) coupled to a buoy 210 (e.g., the flotation device 110 of FIG. 1) of a propulsion system (e.g., the propulsion system 100 of FIG. 1). The buoy 210 can be any shape that is able to keep the battery 205 at a surface of a body of water 260. In this example, the buoy 210 has a boat-like structure. In other examples, the buoy 210 can have a shape selected from the group consisting of: round, oval, square, and rectangle. Also, the buoy 210 can be made up of a composition of materials to ensure that the buoy 210 remains on the surface of the body of water 260. For example, the buoy can have a composition selected from the group consisting of: hollow plastic, foam filled plastic, soft fabric, soft plastic, and a combination thereof The battery 205 is mechanically coupled to the buoy 210. The battery 205, in this example, is positioned on the buoy 210 to maintain optimal flotation balance of the buoy 210. In one example, the position of the battery 205 at the buoy 210 is a function of the shape of the buoy 210. In other examples, the battery 205 can be coupled to the buoy 210 in a position selected from the group consisting of: a top of the buoy, a bottom of the buoy, a side of the buoy, a middle of the buoy, and a combination thereof.

In an example embodiment, the battery 205 can be rechargeable using any known or yet to be known means. For instance, the battery 205 can include solar panels (not shown) configured to recharge the battery 205 using solar energy. In other embodiments, the buoy 210 can include a hydroelectric assembly (not shown) that is configured to recharge the battery by taking advantage of movement of the body of water 260. In one example, the hydroelectric assembly can include blades (not shown) submersed in the body of water 260. The blades are turned by flow/current of the body of water 260. In response to the turning of the blades, the hydroelectric assembly is able to generate electricity in a fashion similar to wind turbines. In another example, the hydroelectric assembly can include transducers (not shown) that are configured to generate electrical energy from mechanical energy associated with movement of the body of water 260.

As discussed herein, the battery 205 is operably coupled to a propulsion assembly (e.g., the propulsion assembly 145 of FIG. 1) including at least one thruster (e.g., the thrusters 115*a-b* of FIG. 1). In particular, the battery 205 is electrically coupled to a first end of the power cable 225 via electrical circuitry 226. In other embodiments, the battery 205 can be directly coupled to the first end of the power cable 225 without the use of the intermediary electrical circuitry 226. A second end of the power cable 225 is electrically coupled to the at least one thruster via the propulsion assembly. Further, the power cable 225 is in a strain relieved configuration with the battery 205 and the propulsion assembly. For instance, the power cable 225 is coupled to a tether cable 230 via a cable bundle 220. The tether cable 230 is mechanically coupled to the buoy 210 to provide strain relief on a first end of the power cable 225 which interfaces with electrical circuitry 226. In one example, to facilitate strain relief, the tether cable 230 is coupled to the buoy 210 at a location distinct from the point of electrical interface between the power cable 225 and electrical circuitry 226. Further, the tether cable 230 can be configured to act as a depth gauge to provide information associated with a depth of an individual (e.g., the individual 140 of FIG. 1). In this example, the tether cable 230 can be configured to further provide signaling to at least one of a reel 206 or a safety flag assembly 211.

In one example, the reel 206 can be configured to tow the individual towards the buoy 210 and above the surface of the body of water 260 in response to receiving the signal from the tether cable 230. Further, the safety flag assembly 211 can be configured to provide an indication of a safety status of the individual in response to receiving the signal from the tether cable 230. In addition, the safety flag assembly 211 can provide an indication of a safety level of the body of water 260. In particular, the safety flag 211 can provide indications similar to those used in the sailing industry. Further, the reel 206 can tow in the individual based on the indication of the safety level of the body of water 260 presented by the safety flag assembly 211.

Figure 3A:
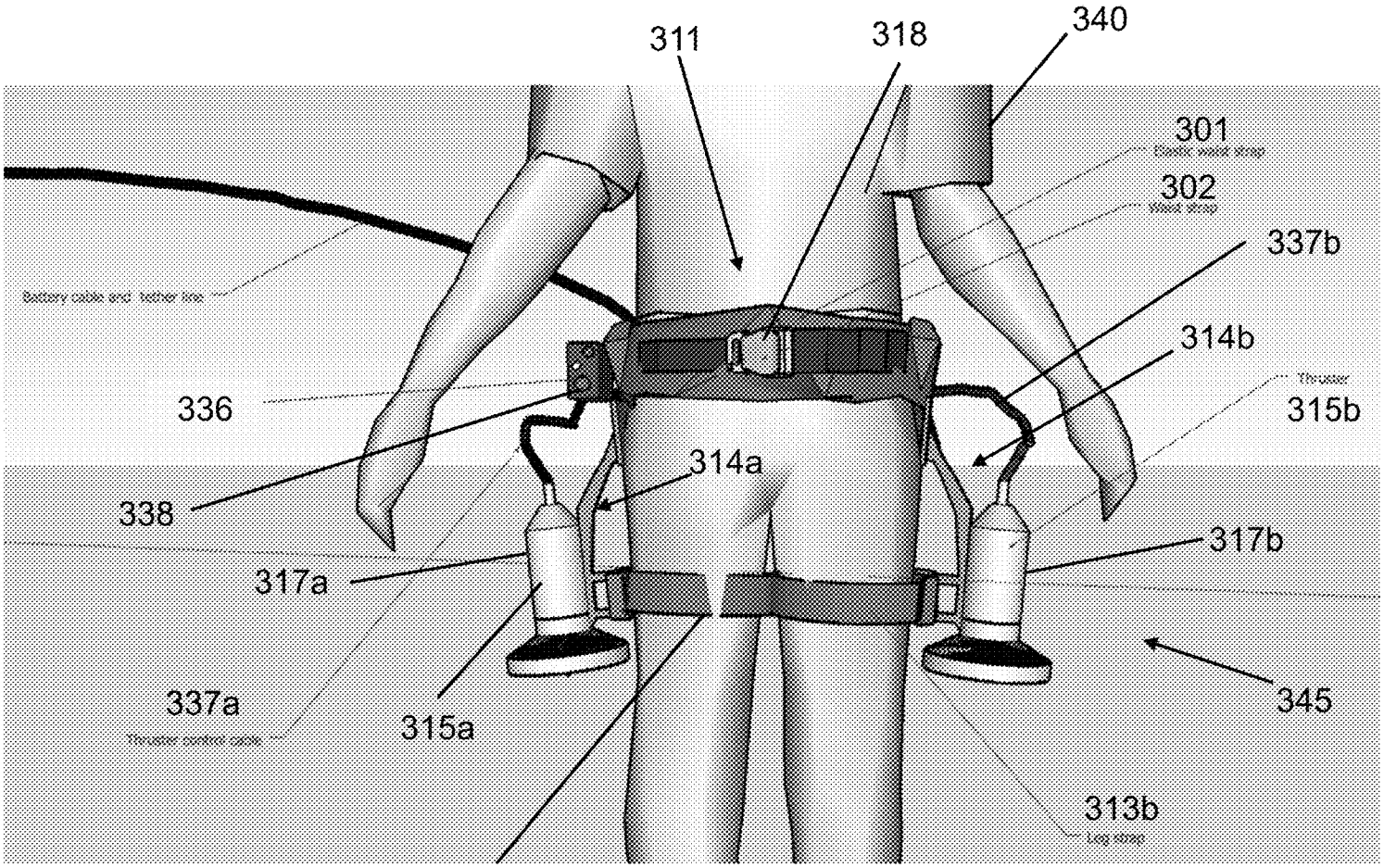
FIGS. 3A-B are schematic illustrations of a propulsion assembly according to an example embodiment of the present disclosure.
Figure 3B:
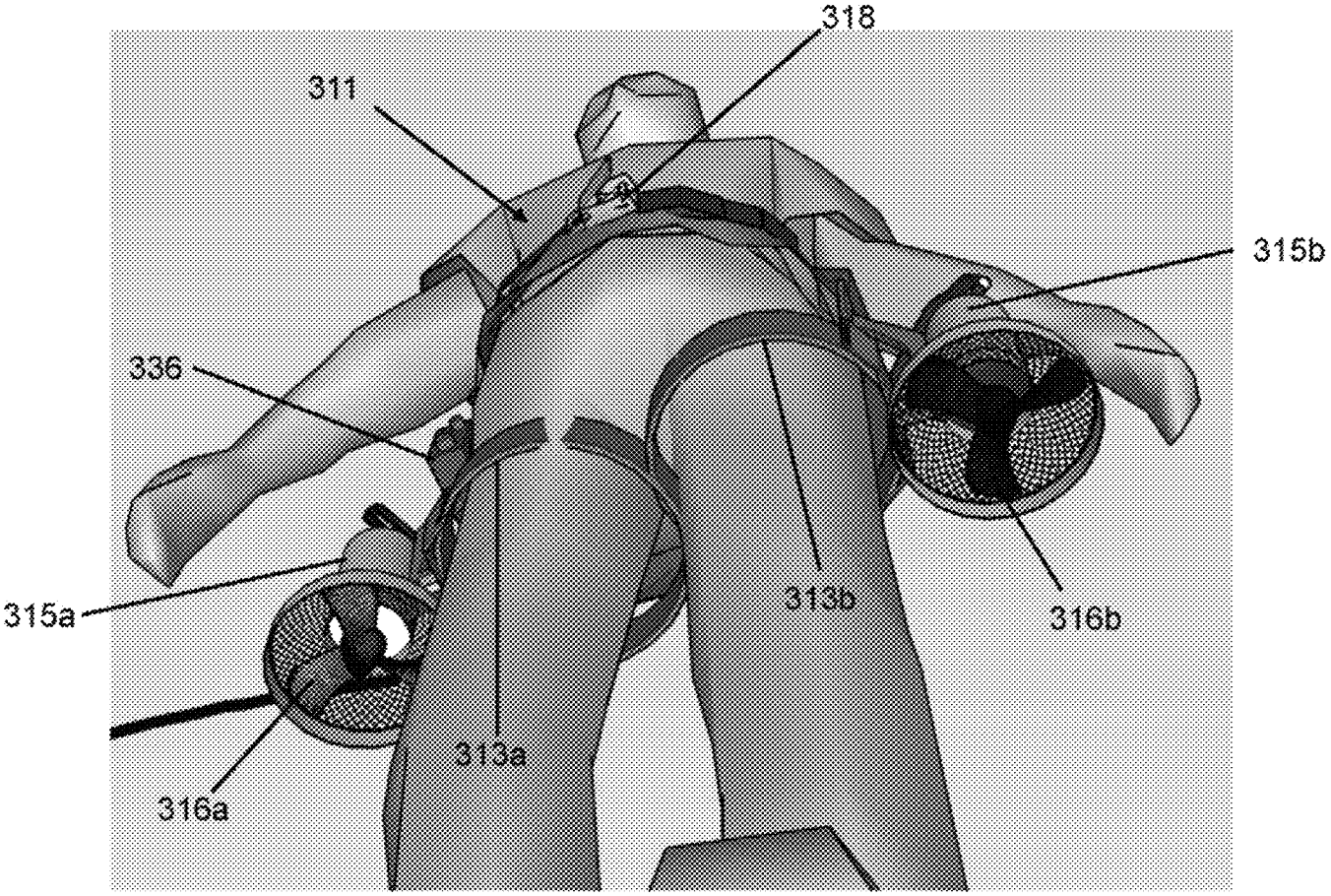

FIGS. 3A-B are schematic illustration of a propulsion assembly 345 coupled to a cable bundle (e.g., the cable bundle 120 of FIG. 1) according to another example embodiment of the present disclosure.

The propulsion assembly 345 can be a hands-free diver propulsion assembly according to one example embodiment of the present disclosure. The assembly 345 includes a flexible harness 311 worn by an individual (e.g., the individual 140 of FIG. 1), first and second spaced apart thigh-mounted thrusters 315*a-b* for propelling the individual through water, and first and second thruster mounting assemblies 314*a-b*. Although the harness 311 is depicted as a waist belt in FIG. 3, the skilled artisan will appreciate that numerous different types of harnesses can be used with systems of the invention to couple the propulsion assembly 345 to other coupling points of the individual (e.g., a waist, a torso, a back, legs, feet, arms, hands, or any combination thereof).

In this example, the thruster mounting assemblies 314*a-b* cooperate with the harness 311 to mount and secure respective thrusters 315*a-b* to upper legs of the individual via leg straps 313*a-b*. However, it should be known that the thrusters 315*a-b* can be configured to be releasably coupled to, using any known coupling means, at least one part of the person selected from the group consisting of: a waist, a torso, a back, legs, feet, arms, hands, and any combination thereof. Further, although two thrusters are illustrated, it should be noted that any number of thrusters can be used (e.g., one or more thrusters). A number of thrusters used can be selected based on size and/or position of the thrusters and in further consideration of ergonomic use and comfort of the propulsion assembly 345 by the individual.

Each thruster 315*a-b* comprises an electric motor (not shown) and drive shaft (not shown) substantially contained within respective sealed cylindrical housings 317*a-b*, and operatively connected (e.g., via speed-reducing gearbox) to respective standard high-speed propellers 316*a-b*. The electric motor may comprise a brushless DC motor. The propeller 316*a-b* may turn at variable speeds of up to 4500 rpm or more. The thruster speed and its ON/OFF states may be controlled by the diver via a rotatable actuator knob 338 on the controller 336. The actuator knob 338 is operatively connected to a potentiometer located inside the controller housing, and can include an ON/OFF switch function at one end of its range of operation.

As illustrated, harness 311 has a levered quick connect/disconnect buckle 318. The buckle 318 can be configured to allow ready and convenient length adjustment to custom fit the harness 311 to the individual. The harness 311 further comprises elastic waist strap 301 and waist strap 302. The waist strap 301 enables size adjustments of the harness 311 to provide a secure customized fit to persons of various size and shape. The waist strap 302 secures the quick connect/disconnect buckle 318 to prevent unwanted disconnect of the harness 311 from the individual during operation of the propulsion assembly 345.

The thruster mounting assemblies 314*a-b* are spaced apart. For example, they are spaced apart approximately 18-24 inches along a length of the harness 311. By this arrangement, the thrusters 315*a-b* mount substantially adjacent to respective outer thighs of the diver when the propulsion assembly 345 is properly positioned and secured. The thrusters 315*a-b* are electrically connected to a power source (e.g., the power source 105 of FIG. 1) and motor controller 336, and operate in a conventional manner to propel the individual through water. In one example, the controller 336 can be configured to provide variable speed control of the thrusters 315*a-b* via thruster control cables 337*a-b*.

In addition, the controller 336 can be releasably attached to the harness 311 by cooperating straps, mating fasteners, clips, pockets, or other suitable means (e.g., mounting plates). Alternatively, these components may be attached at any other location on the body of the diver, or on other equipment or devices carried by the diver.

Figure 4:
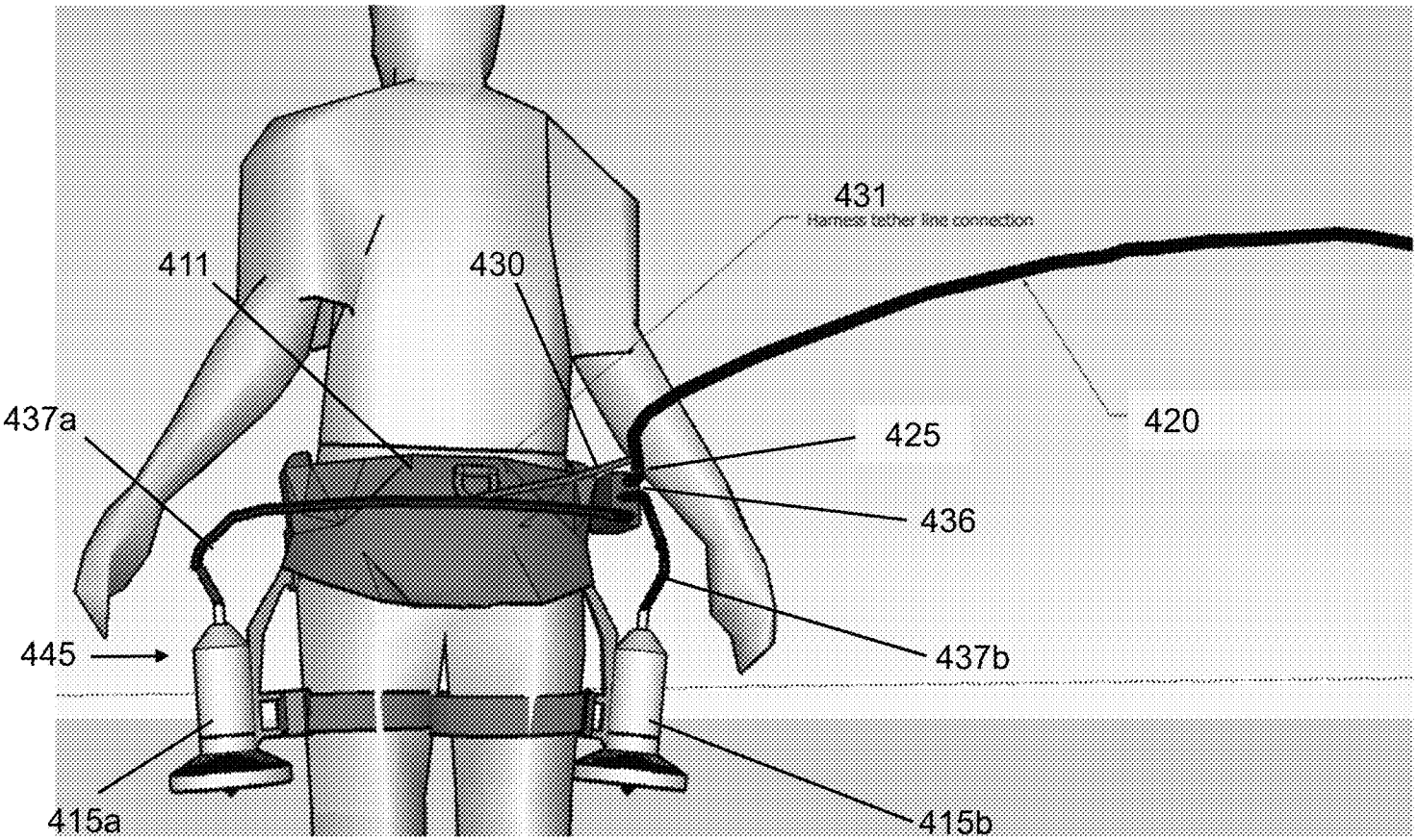
FIG. 4 is a schematic illustration of a rear view of a propulsion assembly according to an example embodiment of the present disclosure.

FIG. 4 is a schematic illustration of a rear view of a propulsion assembly 445 according to an example embodiment of the present disclosure.

The propulsion assembly 445 includes a flexible harness 411 worn by an individual (e.g., the individual 140 of FIG. 1). A controller 436 is releasably attached to the harness 411 by cooperating straps, mating fasteners, clips, pockets, or other suitable means. The controller 436 is connected to a power cable 425 via a watertight electrical connector. Thrusters 415*a-b* are electrically connected to a power source (e.g., the power source 105 of FIG. 1) via the controller 436, and operate in a conventional manner to propel the individual through water. For example, the controller 336 can be configured to provide variable speed control of the thrusters 315*a-b* via thruster control cables 337*a-b*. Additionally, in this configuration, the controller 436 acts as an electrical router configured to route power to the thrusters 415*a-b*.

The power cable 425 is strain relieved using the tether cable 430 that is coupled to the power cable 425 via cable bundle 420. The cable bundle 420 can be composed of a series of ties or straps. Alternatively or additionally, the cable bundle 420 can be a plastic and/or cloth mesh wrapped around the tether cable 430 and the power cable 425. In fact, the cable bundle 420 can comprise any known means for coupling at least two cables. Further, the cable bundle 420 can be made of any material suitable to maintain coupling of the tether cable 430 and the power cable 425 in an aqueous environment.

To provide strain relief to the power cable 425, the tether cable 430 is coupled to a harness tether cable connection

431. The harness tether cable connection 431 can be a ring made of a durable material that is coupled to a rear mid-section of the flexible wait belt. Accordingly, the tether cable 430 can be coupled to the harness tether cable connection 431 via, for example, a carabiner (not shown), which is located at an end of the tether cable 431 that interfaces with the propulsion assembly 445. In this configuration, the tether cable 430 redirects stress away from the electrical connection between the controller 436 and the power cable 425. In particular, the stress is redirected to the harness 411.

Figure 5A:
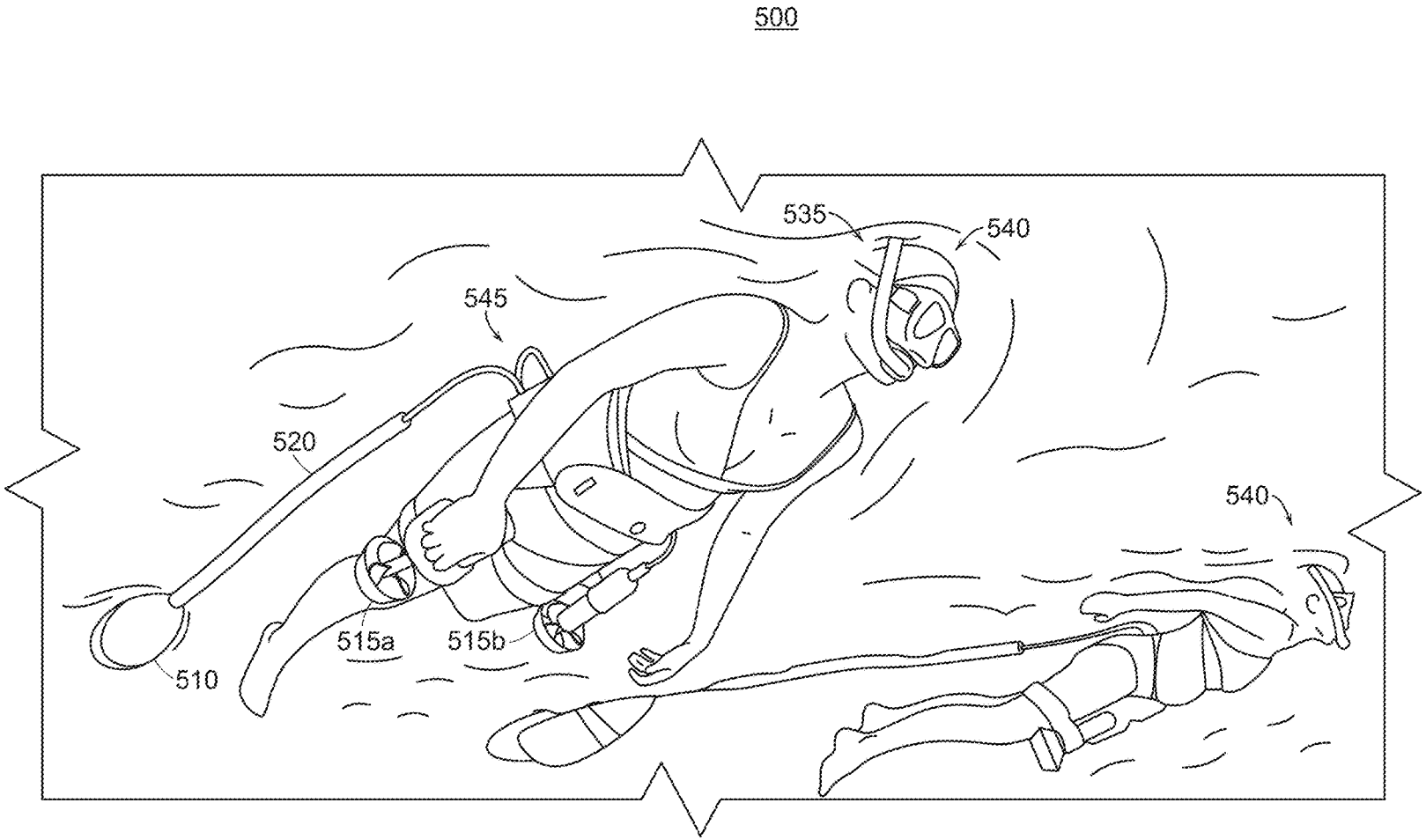
FIGS. 5A-C illustrate a propulsion system in use by snorkelers according to an example embodiment of the present disclosure.
Figure 5B:
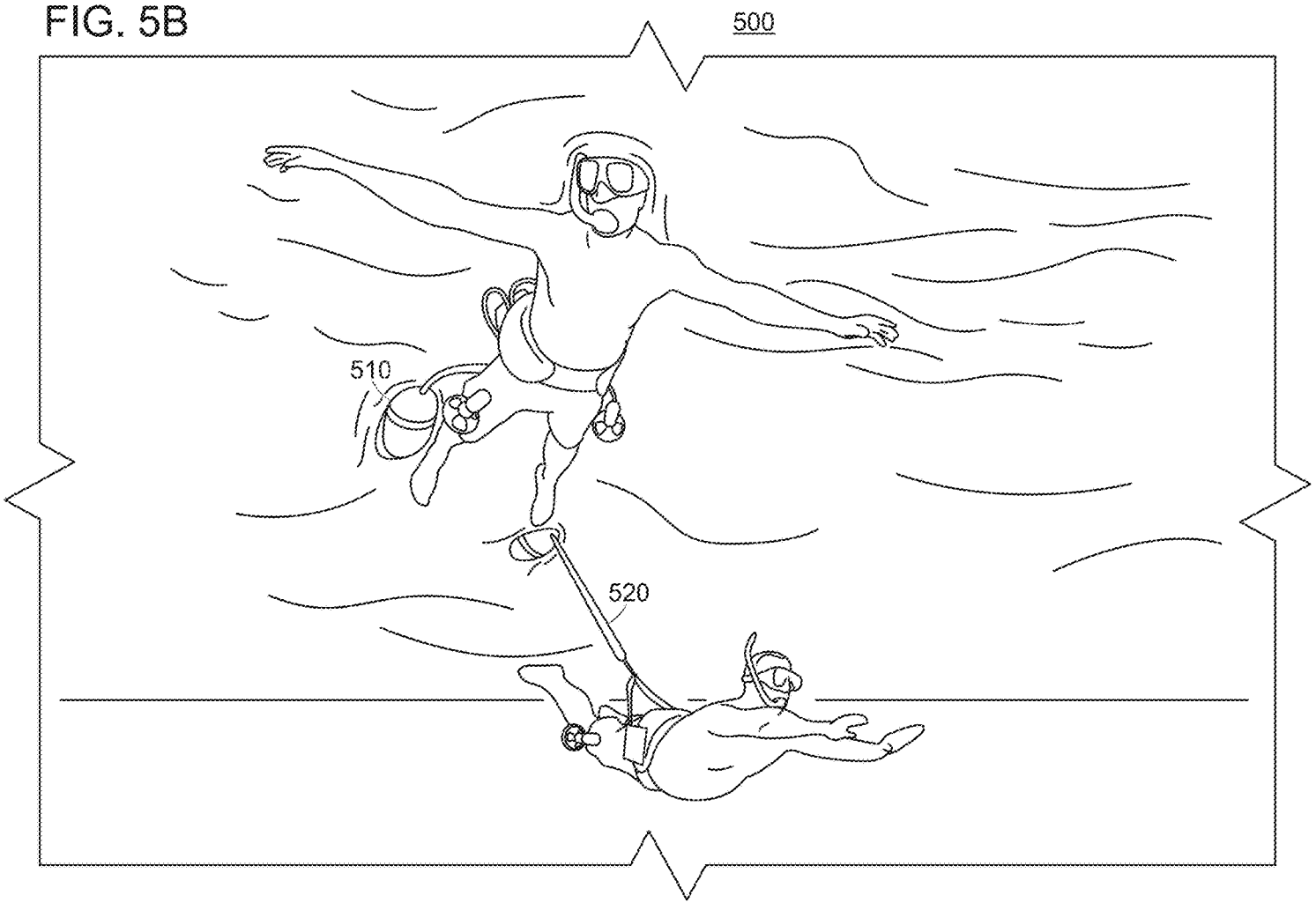
Figure 5C:
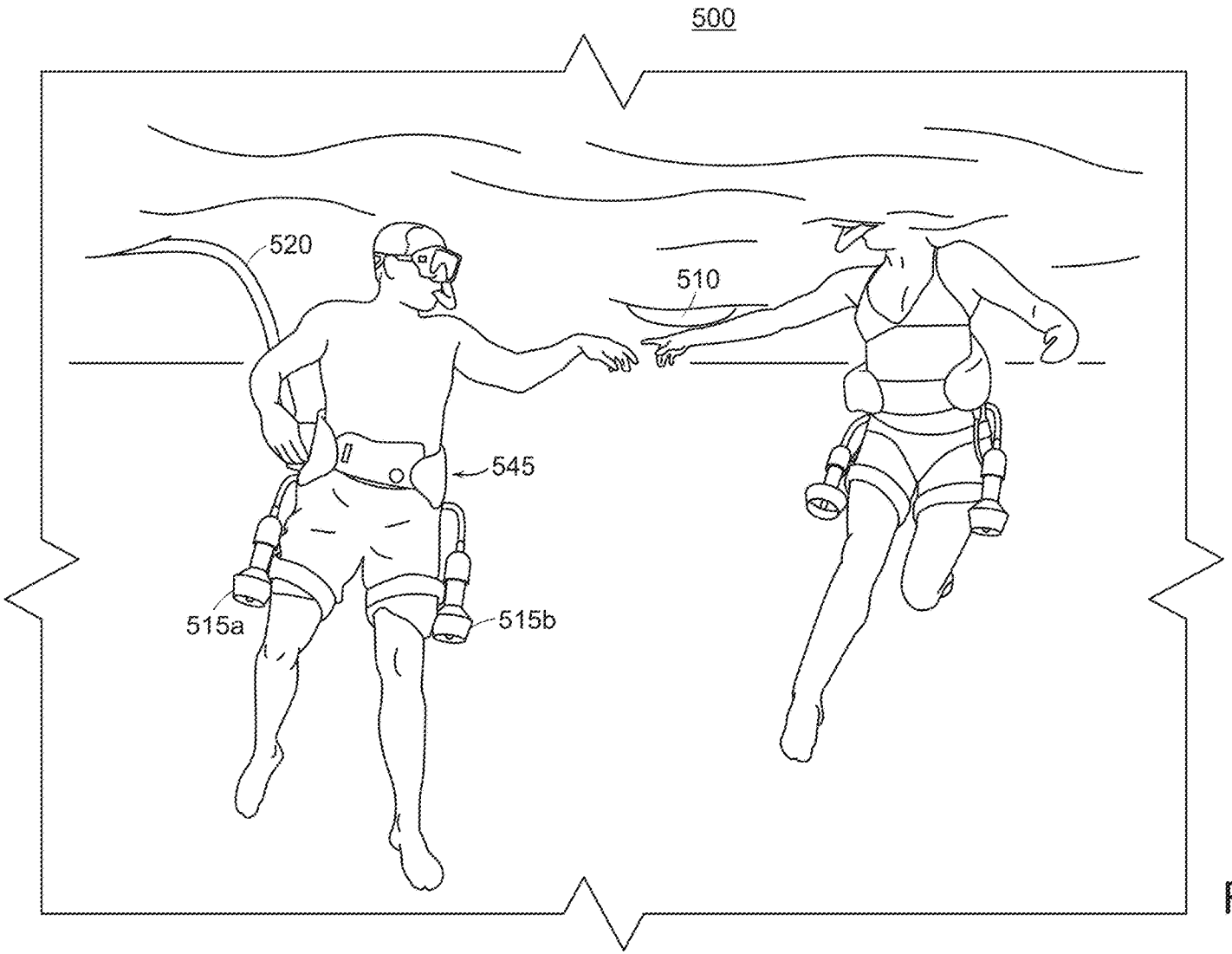

FIGS. 5A-C illustrate a propulsion system 500 in use by snorkelers 540 using snorkeling equipment 535. The propulsion system 500 includes a buoy 510 that houses a power source (not shown). The buoy 510 and the power source are operably coupled to a propulsion assembly 545 via a cable bundle 520. The cable bundle houses a power cable (e.g., the power cable 125 of FIG. 1) and a tether cable (e.g., the tether cable 130 of FIG. 1). The snorkelers 535 propel themselves through water using the thrusters 515*a-b*. The thrusters 515*a-b* receive power from the power source housed by the buoy 510 via the power cable housed by the cable bundle 520.

The teachings of all patents, published applications and references cited herein are incorporated by reference in their entirety.

While this disclosure has been particularly shown and described with references to example embodiments thereof, it will be understood by those skilled in the art that various changes in form and details may be made therein without departing from the scope of the present disclosure encompassed by the appended claims.

What is claimed is:

1. An propulsion system, the system comprising:

a power source coupled to a flotation device;

at least one thruster configured to be coupled to a person; and a power cable that operably couples the power source and the at least one thruster, wherein the system is configured such that the at least one thruster propels the person through the water while the power source remains at a surface of the water and coupled to the flotation device.

2. The propulsion system of claim 1, wherein the power source is includes at least a rechargeable power source, a single use battery, a fueled power source, or any combination thereof.

3. The propulsion system of claim 1, wherein the flotation device configured to float on a surface of the water, and wherein the flotation device is a buoy, a small craft including at least one of an inflatable raft or boat, or any combination thereof.

4. The propulsion system of claim 3, wherein the power source is coupled to the buoy in a position selected from the group consisting of: a top of the buoy, a bottom of the buoy, a side of the buoy, a middle of the buoy, and a combination thereof.

5. The propulsion system of claim 4, wherein the buoy has a shape selected from the group consisting of: round, oval, square, rectangle, or any combination thereof.

6. The propulsion system of claim 4, wherein the buoy has a composition selected from the group consisting: hollow plastic, foam filled plastic, soft fabric, soft plastic, and any combination thereof.

7. The propulsion system of claim 1, wherein the power cable is an electrical transmission line providing electrical communication between the power source and the at least one thruster.

8. The propulsion system of claim 7, wherein the coupling among the power source, the power cable, and the at least one thruster is in a strain relieved configuration.

9. The propulsion system according to claim 8, wherein the strain relieved configuration comprises the power cable comprising a strain relief cord grip configured to relieve tension from the power cable.

10. The propulsion system of claim 7, the strain relieved configuration comprises a tether cable configured to couple the buoy to the person, wherein the tether cable is coupled to the power cable to provide strain relief to the power cable.

11. The system of claim 10, further comprising a reel coupled to the buoy, the reel being configured to reel the person via the tether cable to the surface of the water.

12. The propulsion system according to claim 1, wherein the at least one thruster is configured to be releasably coupled at least one part of the person selected from the group consisting of: a waist, a torso, a back, legs, feet, arms, hands, and any combination thereof.

13. The propulsion system of claim 1, further comprising a controller.

14. The propulsion system according to claim 12, wherein the controller is configured to afford control of the at least one thruster.

15. The propulsion system of claim 1 wherein the at least one thruster is a plurality of thrusters.

16. The propulsion system of claim 1, further comprising:

a harness adapted for wear by the person;

an electrical router configured to provide an electrical connection to the power cable and to route power to the at least one thruster, the electrical router being housed by the harness; and a controller configured to provide user controls to at least the at least one thruster, the controller being housed by the harness, the controller in electrical communication with the electrical router.

17. A propulsion system, the system comprising:

an air supply assembly;

a power source coupled to a flotation device;

at least one thruster configured to be coupled to a person; and a power cable that operably couples the power source and the at least one thruster, wherein the system is configured such that the at least one thruster propels the person through the water while the power source remains at a surface of the water and coupled to the flotation device.

18. The propulsion system of claim 16, wherein the air supply assembly comprises a snorkel and a mask, surface supplied air systems, compressed gas diving systems, or any combination thereof.

19. The propulsion system of claim 17, further comprising a controller.

20. The propulsion system of claim 17, wherein the coupling among the power source, the power cable, and the at least one thruster is in a strain relieved configuration.

* * * * *